US009464478B2

(12) United States Patent
Defenbaugh et al.

(10) Patent No.: US 9,464,478 B2
(45) Date of Patent: Oct. 11, 2016

(54) LIGHT BLOCKING SLATTED BLIND

(71) Applicant: Newell Window Furnishings, Inc., High Point, NC (US)

(72) Inventors: Michael Defenbaugh, Dunwoody, GA (US); Joshua Maust, Roswell, GA (US); Teresa Williamson, Marietta, GA (US); Peter Bates, Framingham, MA (US); Henry Sick, Boston, MA (US)

(73) Assignee: Levolor, Inc., Atlanta, GA (US)

( * ) Notice: Subject to any disclaimer, the term of this patent is extended or adjusted under 35 U.S.C. 154(b) by 0 days.

(21) Appl. No.: 14/628,348

(22) Filed: Feb. 23, 2015

(65) Prior Publication Data

US 2015/0167381 A1 Jun. 18, 2015

Related U.S. Application Data

(63) Continuation of application No. 13/370,475, filed on Feb. 10, 2012, now Pat. No. 8,991,469.

(60) Provisional application No. 61/441,297, filed on Feb. 10, 2011.

(51) Int. Cl.

| | |
|---|---|
| ***E06B 9/303*** | (2006.01) |
| ***E06B 9/307*** | (2006.01) |
| ***E06B 9/384*** | (2006.01) |
| ***E06B 9/386*** | (2006.01) |

(52) U.S. Cl.

CPC ..... *E06B 9/307* (2013.01); *E06B 9/303* (2013.01); *E06B 9/384* (2013.01); *E06B 9/386* (2013.01)

(58) Field of Classification Search

CPC ..... E06B 9/386; E06B 9/307; E06B 9/384; E06B 9/303

USPC ..... 160/176.1 R, 178.3, 236

See application file for complete search history.

(56) References Cited

U.S. PATENT DOCUMENTS

| | | | |
|---|---|---|---|
| 723,762 | A | 3/1903 | Tumler |
| 2,061,548 | A | 11/1936 | Cameron |
| 2,111,979 | A | 3/1938 | Lawson et al. |
| 2,121,217 | A | 6/1938 | Ellis |
| 2,218,508 | A | 10/1940 | Gentile |
| 2,405,255 | A | 8/1946 | Horton |
| 2,618,330 | A | 11/1952 | Janowski |
| 2,620,865 | A | 12/1952 | Isserstedt |
| 2,728,108 | A | 12/1955 | Schlegel, Jr. |
| 2,749,976 | A | 6/1956 | Lewis |
| 3,332,471 | A | 7/1967 | Croxen |

(Continued)

OTHER PUBLICATIONS

Window covering sold by Vista Products, Inc.

*Primary Examiner* — Blair M Johnson

(74) *Attorney, Agent, or Firm* — Dority & Manning, P.A.

(57) ABSTRACT

A slatted blind is configured such that the slats close create a light blocking blind. The slats may be supported by a tilt cord that comprises a low stretch strand or a low stretch cord may be attached to the tilt cord. The slats may be connected to the supporting tilt cord such that when the slat is rotated to a closed position the slat is suspended from the rung. The rung may have an effective diameter of less than approximately 14 mil. Recesses may be formed in the slat for receiving the rung when the slat is in a closed position. A bottom rail may have a thickness approximately equal to the thickness of the slats. A protrusion may be formed on the back of the slats such that the rung pushes on the protrusion to force the slat against an adjacent slat when the blind is closed.

8 Claims, 12 Drawing Sheets

(56) References Cited

U.S. PATENT DOCUMENTS

| | | | | |
|---|---|---|---|---|
| 4,292,763 | A | 10/1981 | Barnes et al. | |
| 4,588,012 | A * | 5/1986 | Anderson | E06B 9/264 160/107 |
| 5,597,027 | A | 1/1997 | Simon et al. | |
| 5,769,140 | A | 6/1998 | Tuzmen | |
| 5,957,183 | A | 9/1999 | Prince | |
| 6,263,944 | B1 | 7/2001 | Judkins | |
| 2004/0065418 | A1 | 4/2004 | Colson | |
| 2005/0230063 | A1 | 10/2005 | Hwang | |
| 2009/0321024 | A1 | 12/2009 | Harper et al. | |
| 2012/0234506 | A1 | 9/2012 | Defenbaugh et al. | |

* cited by examiner

LIGHT BLOCKING SLATTED BLIND

This application is a continuation application of U.S. application Ser. No. 13/370,475, filed on Feb. 10, 2012, which, in turn, claims benefit of priority under 35 U.S.C. §119(e) to the filing date of U.S. Provisional Application No. 61/441,297, as filed on Feb. 10, 2011, both of which are incorporated herein by reference in their entirety.

BACKGROUND

Window coverings provide aesthetics, privacy and light control. One type of window covering is a slatted blind that comprises a plurality of slats suspended from a head rail. The slats may be articulated between an open position where the slats are spaced from one another and closed positions where the slats are rotated toward one another to create a privacy panel.

SUMMARY OF THE INVENTION

A blind comprises a plurality of slats supported by a tilt cord where the tilt cord comprises a low stretch strand.

The low stretch strand may exhibit less than a 1% elongation. The low stretch strand may maintain the plurality of slats at an angle of approximately 4 to 5 degrees relative to vertical. The tilt cord may comprise a first support cord and a second support cord having a plurality of rungs extending between the first support cord and the second support cord where the plurality of rungs support the plurality of slats. At least one of the first support cord and the second support cord and the plurality of rungs comprise the low stretch strand. The first support cord and the second support cord may comprise the low stretch strand.

A blind comprises a plurality of slats supported by a tilt cord. A low stretch cord is attached along the length of the tilt cord.

A blind comprises a slat supported by a tilt cord where the tilt cord comprises a first support cord and a second support cord having a rung extending between the first support cord and the second support cord, the rung supporting the slat, the slat being connected to the rung such that when the slat is rotated to a closed position the slat is suspended from the rung. The slat may be connected to the rung at the transverse midpoint of the slat. The slat may be connected to the rung by a connector that allows the slat to be suspended from the rung. The connector may be selected from one of an adhesive; a sonic weld; a tape; a mechanical fastener; an interference fit; a snap clip; a staple; a molded bead or a knot that is snapped into a slot on the slat; loops formed on the rung that hook over a peg formed on the slat; a lift cord that is threaded through each of the slats and engages each rung; and a two-piece slat that traps the rung between the two slat pieces or the like.

A blind comprises a slat supported by a tilt cord where the tilt cord comprises a first support cord and a second support cord having a rung extending between the first support cord and the second support cord. The rung supports the slat and has an effective diameter of less than or equal to approximately 14 mil. The rung may comprise a single strand.

A blind comprises a slat supported by a tilt cord where the tilt cord comprises a first support cord and a second support cord having a rung extending between the first support cord and the second support cord. The rung supports the slat where recesses are formed in the slat for receiving the rung when the slat is in a closed position.

A blind comprises a plurality of slats, each of the plurality of slats having a thickness; a tilt cord comprising a first support cord and a second support cord having a plurality of rungs extending between the first support cord and the second support cord where the rungs support the slats. A bottom rail is secured to the bottom of the plurality of slats where the bottom rail has a thickness approximately equal to the thickness of the plurality of slats.

A blind comprises a slat supported by a tilt cord where the tilt cord comprises a first support cord and a second support cord having a rung extending between the first support cord and the second support cord where the rung supports the slat. A protrusion is formed on the back of the slats such that the rung pushes on the protrusion to force the slat against an adjacent slat when the tilt cord and slat are articulated to the closed position.

The protrusion may be a separate member attached to the back surface of the slat by a separate attachment mechanism. The protrusion may be formed integrally with the slat where the protrusion and slat are formed as a single, unitary piece. The protrusion may be arranged on slat such that it is disposed between the ladder cord and the slat.

DETAILED DESCRIPTIONS OF EMBODIMENTS OF THE INVENTION

Because of the difficulty in making light blocking slatted blinds, light blocking shades are the window treatment of choice where light blocking is desired such as in bedrooms or media rooms. A slatted blind that is able to close fully such that it provides light blocking functionality is disclosed herein. The blind of the present invention closes and blocks light in a manner that allows the blind to be used when light control is desired. In addition, because the blind closes fully, the blind provides the added benefit of blocking air drafts which can lead to decreased energy bills.

In a typical existing slatted blind light may pass between adjacent slats even when the blind is in a closed position because of gaps between the slats. These gaps may be especially pronounced at the bottom and top of the blind panel. In addition, gaps may also be present throughout the height of the blind due to the non-planarity of the slats and the inability of the slats to fully close.

Figure 1:
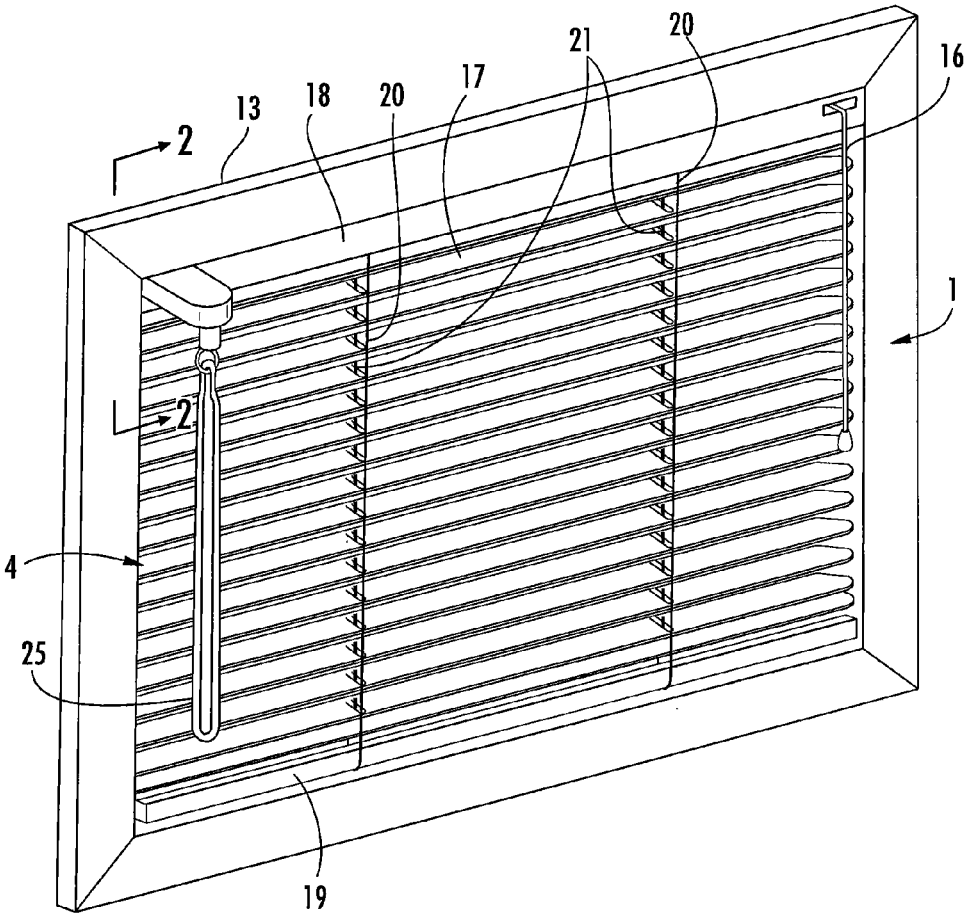
FIG. 1 is a perspective view of an embodiment of a window covering of the invention.
Figure 2:
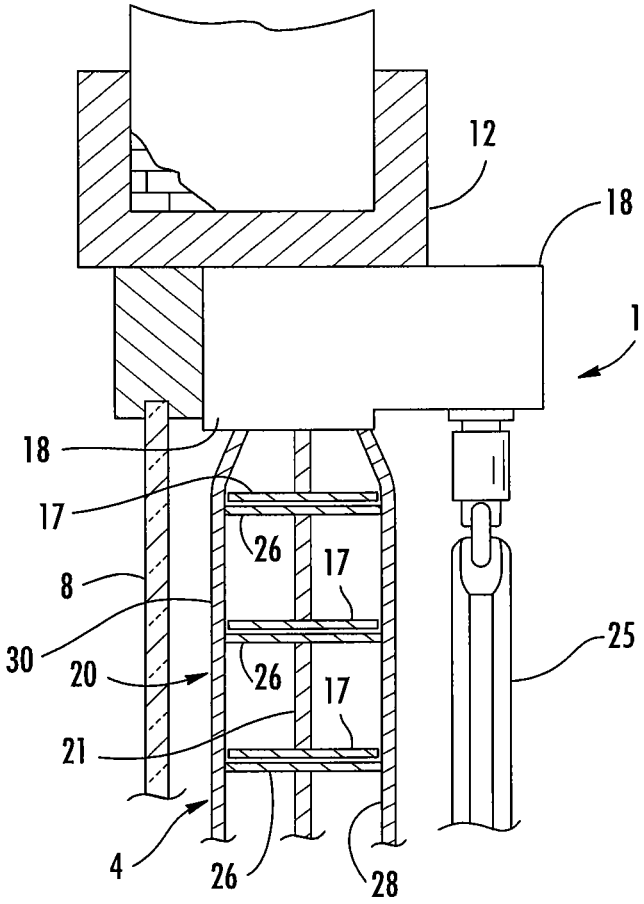
FIG. 2 is a partial section view of the window covering of FIG. 1.

Referring to FIGS. 1 and 2 an embodiment of a window covering 1 is shown comprising a head rail 18 from which a slatted blind 4 is suspended. The slatted blind comprises a plurality of slats 17. The head rail 18 may be constructed of wood, steel or other rigid material and may be solid or have an interior channel. It is appreciated that, in some embodiments, the term "head rail" need not be limited to a traditional head rail structure and may include any structure, component or components from which a shade may be suspended or supported and which may include operating systems and/or shade control components. The head rail 18 may be mounted to a window frame 13 or other architectural feature by brackets or other mounting mechanism to cover the window or other opening 8. The slatted blind 4 has a top edge that is located adjacent to the head rail 18 and a bottom edge remote from the head rail 2 that may terminate in a bottom rail 19.

The slats 17 may be supported by lift cords 21 that are connected to the bottom of the shade 4 or to the bottom rail 19 where the lift cords 21 may be retracted toward the head rail 18 to raise the shade or extended way from the head rail to lower the shade. The lift cords 21 may be operatively connected to a pull cord 16 or other user control that may be manipulated by the user to raise and lower the slats.

The slats 17 are also supported by a tilt cord 20 that functions to tilt the slats 17 between an open position where the slats 17 are spaced from one another and closed positions where the slats 17 are disposed in an abutting, overlapping manner to create a light blocking panel. The tilt cord 20 may comprise a ladder cord as shown that supports the individual slats 17 where manipulation of the ladder cord results in the tilting of the slats between the open position, the closed positions and any intermediate position. The tilt cord 20 may be controlled by a user control 25 such as a control wand or cord that is manipulated by the user to adjust the opening and closing of the slats. Typically, the slats will be supported by two or more tilt cords 20 and two or more lift cords 21 depending upon the width of the window covering. A variety of cord control mechanisms may be provided to control and manage the lift cords and tilt cords including cord locks, control drums, brakes and the like. While a specific embodiment of a window covering is disclosed, the window covering may have a wide variety of constructions. For example, the pull cord may be replaced by a spring motor or an electric motor to control the raising and lowering of the slats. The tilt cord may be replaced by ribbons or other flexible member for tilting the slats and the control of the tilting of the slats may be accomplished using an electric motor or other control. Further, the slats 17 may have a variety of configurations and finishes and may be made of any suitable material including, but not limited to, wood, metal, plastic, composites or the like.

Figure 4:
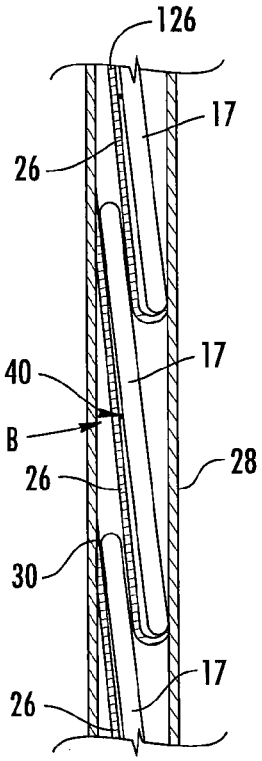
FIG. 4 is a side view of an embodiment of the window covering of the invention.

Each tilt cord 20 may comprise a ladder cord that has a plurality of rungs 26 that are connected to and supported at each end by vertical support cords 28 and 30. A slat 17 rests on top of and is supported by each rung 26. A drum or other control device may be rotated by a user using a control 25 such that the front vertical support cord 28 may be raised or lowered while the back vertical support cord 30 is simultaneously lowered or raised, respectively, to tilt the rungs 26 between fully closed positions, a fully open position or any intermediate position. In the fully open position the rungs 26 and slats 17 are disposed substantially perpendicular to the vertical support cords 28 and 30 to minimize the obstruction caused by the slats as shown in FIG. 2. In either of the fully closed positions the slats are arranged near vertically where adjacent slats are in an abutting, overlapping relationship as shown in FIG. 4. A typical slatted blind has two fully closed positions because the slats may be rotated approximately 180 degrees such that either longitudinal edge of the slats may be in the top position when the blinds are fully closed.

Figure 3:
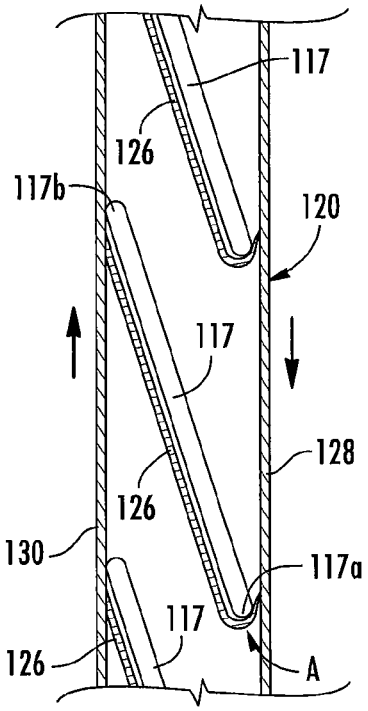
FIG. 3 PRIOR ART
FIG. 3 is a side view of a prior art window covering.

When a typical slatted blind is fully closed, the slats near the top of the blind are at an angle of approximately 4 to 5 degrees relative to vertical. However, the slats nearer to the bottom edge of the blind "slouch" and are at an angle of almost 20 degrees relative to vertical as shown in FIG. 3. The slats that are disposed at an angle of 4 to 5 degrees relative to vertical operate in a light blocking manner because the slats are in the desired overlapping and abutting relationship relative to one another. The slats that slouch at a greater angle relative to vertical do not close completely because the slats, even when the tilt cord is in the fully closed position, are spaced from one another and do not assume the desired abutting and overlapping relationship.

Referring to FIG. 3, a typical prior art blind made of braided polyester tilt cord 120 is shown in the closed position where the slats 117 are disposed at an angle such that the slats slouch and are not fully closed. The slouching of the slats is attributed, at least in part, to the difference in loading between the front vertical support cord 128 and the rear vertical support cord 30. When the blinds are in the closed position one of the vertical cords 128, 130 is raised and one of the vertical cords 128, 130 is lowered. In the illustrated embodiment the rear cord 130 is raised and the front cord 128 is lowered such that the rungs 126 tilt downward from the back of the blind to the front of the blind. To simplify the explanation, the raised cord will be referred to as the upper cord and the lowered cord will be referred to as the lower cord. In the fully closed position, the slats 117 are supported at their bottom edge 117*a*. The lower edge 117*a* of slat 117 rests on the rung 126 at point A. The slat 117 simply rests on the rung 126 such that when the blind is closed the weight of the slat leans against the rung and tends to force the upper cord away from the lower cord. It has been found that one reason the lower slats "slouch" is that the upper cord 130 stretches about 0.25 inches longer than the lower cord 128 over a length of 40 slats. As a result, at the top of the blind the tension on the rungs maintains the upper and lower cords in proper parallel alignment but toward the bottom of the blind the upper and lower cords spread such that the slats 117 lean against the rungs 126 and slouch to a larger than desired angle relative to vertical. As a result, the top edge 117*b* of one slat is not in an abutting relationship with the adjacent slat.

Referring to FIGS. 1 and 2, in one embodiment of the blind of the invention the slouching of the slats is lessened by making the tilt cord 20 out of a very low stretch strand. In one embodiment the vertical support cords 28, 30 and the rungs 26 may be made out of very low stretch strands. In another embodiment the vertical support cords 28 and 30 may be made of low stretch strands with the rungs 26 being made of standard strands. Using low stretch fiber minimizes the length difference between the upper cord and the lower cord and helps to prevent the slouching of the slats. Existing ladder fibers elongate about 1.89%. Low stretch ladder fibers that elongate less than about 1% are suitable for use in a blind. Tests were performed that showed that low stretch fibers may lessen the stretch of the cords by over 60% and with some fibers the stretch may be reduced by 80%. Suitable fibers are para-aramid synthetic fibers such as 0.025 inch Kevlar® or 0.014 inch Kevlar®; or self-fibrillating polypropylene/polyethylene blended synthetic macro-fibers such as TUF® 15 lb fibers or TUF® 50 lb fibers. In one embodiment the TUF® fibers are preferred for sewing ladder rungs. Other non-stretch fibers are commercially available. Moreover, a non-stretch cord such as steel wire or cable may also be used.

Figure 9:
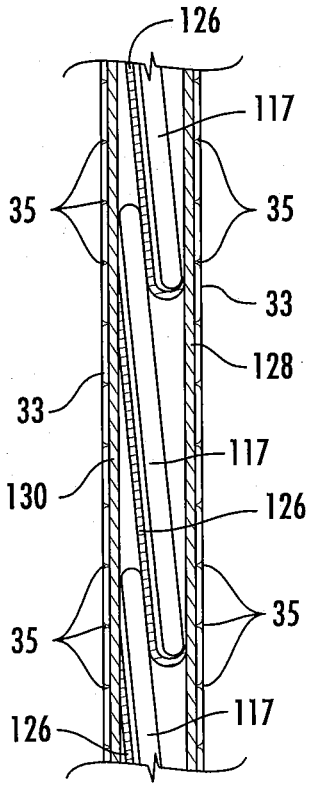
FIG. 9 is a side view of still another embodiment of the window covering of the invention.

In order to reduce the stretch of the tilt cord, low stretch fibers can be used to form the tilt cord 120 as described above. Alternatively, a low stretch ribbon, cord or similar device 33 may be adhered or connected to an existing tilt cord by adhesive, stitches, or other connector 35 in a manner that prevents the stretching of the ladder cord as shown in FIG. 9. The low stretch cords 33 may be attached to the tilt cord 120 at spaced intervals along the length of the vertical support cords 128 and 130 such that the low stretch cord 33 restrains the tilt cord 120 from stretching.

Figure 10:
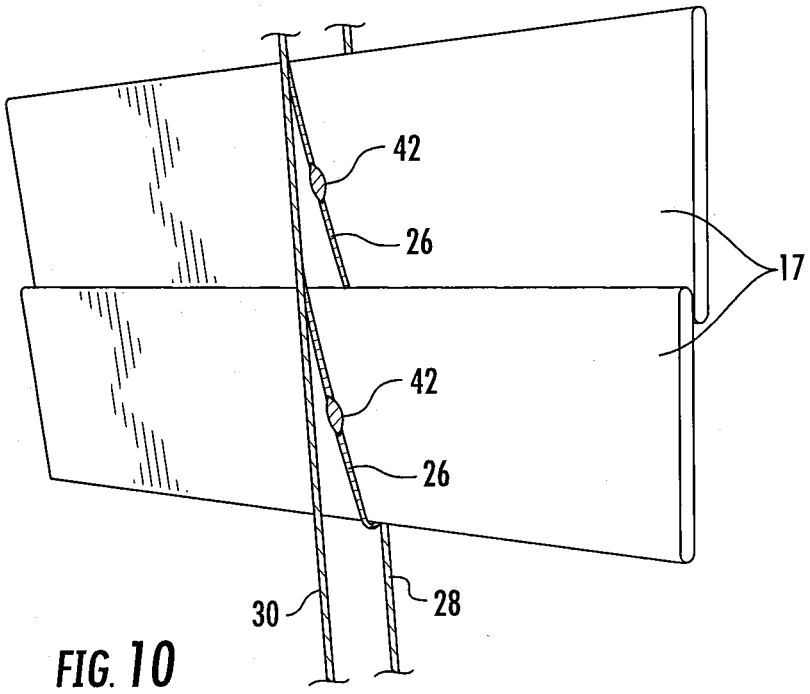
FIGS. 10 through 19 are detailed perspective views showing various embodiments of the window covering of FIG. 4.
Figure 11:
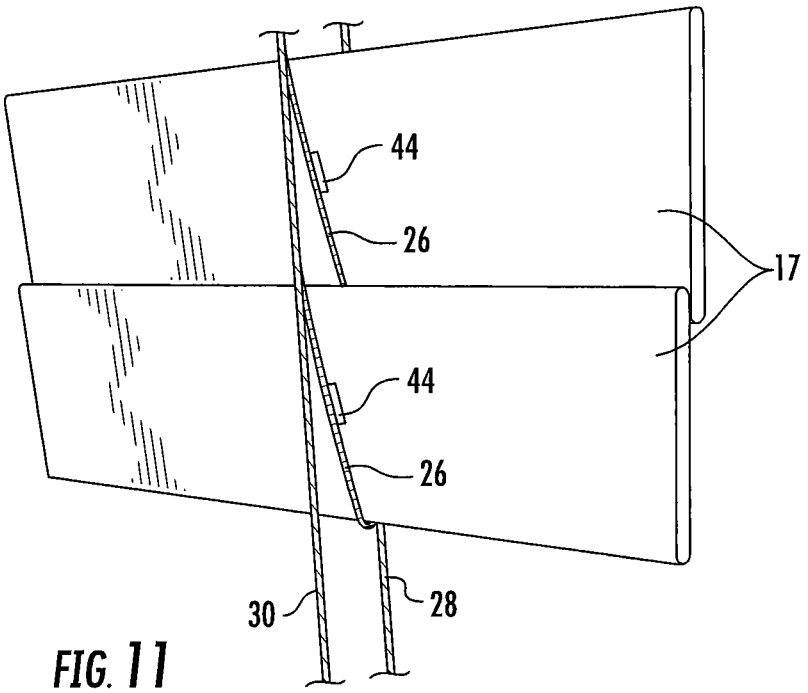
Figure 12:
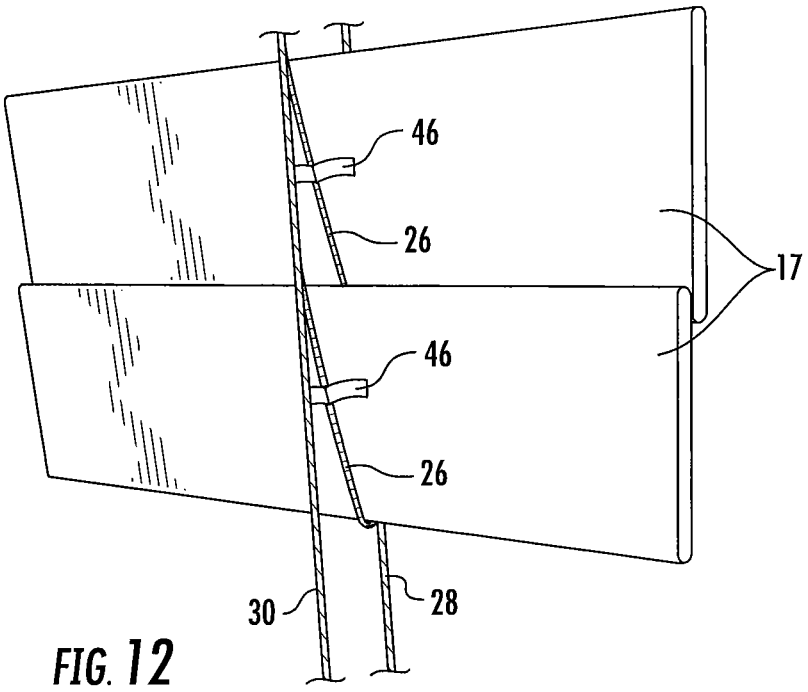
Figure 13:
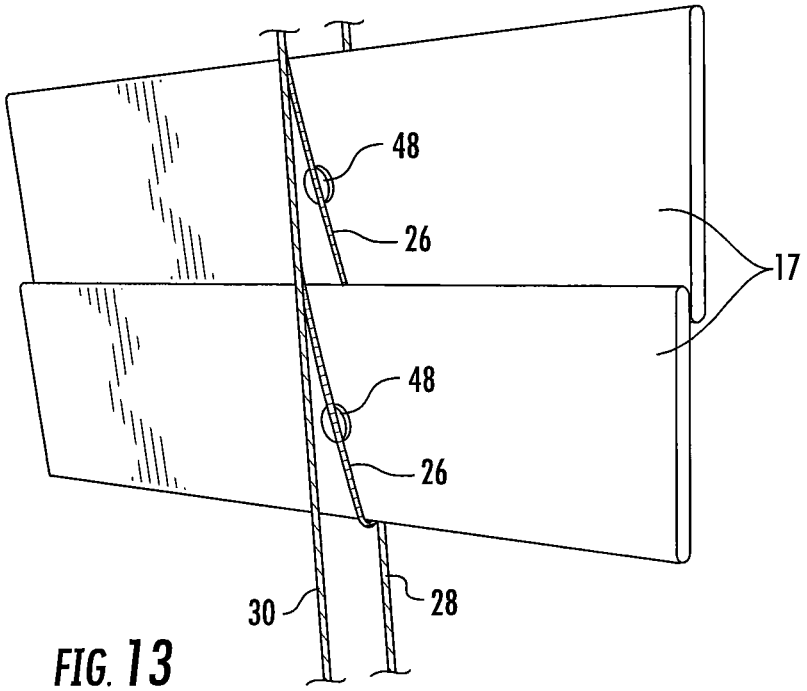
Figure 14:
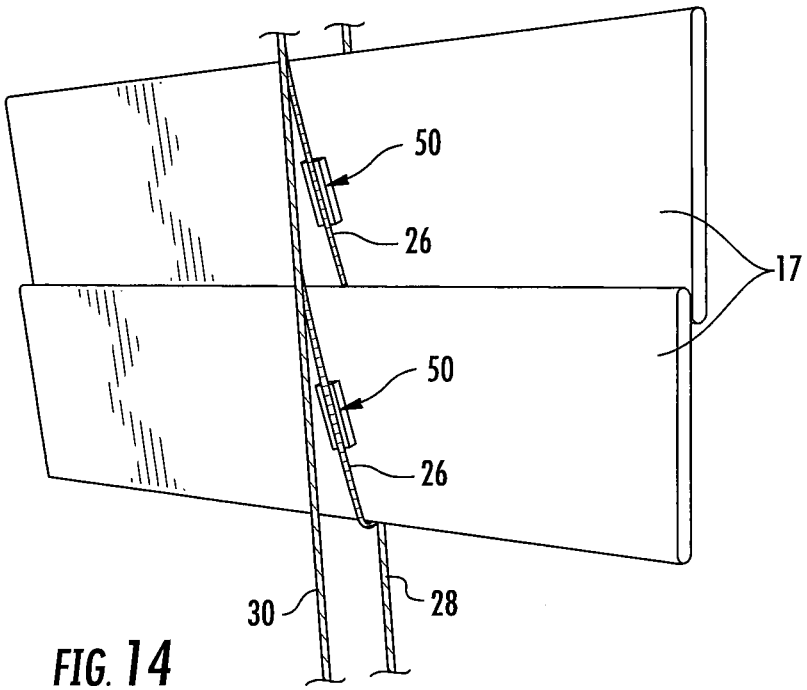
Figure 15:
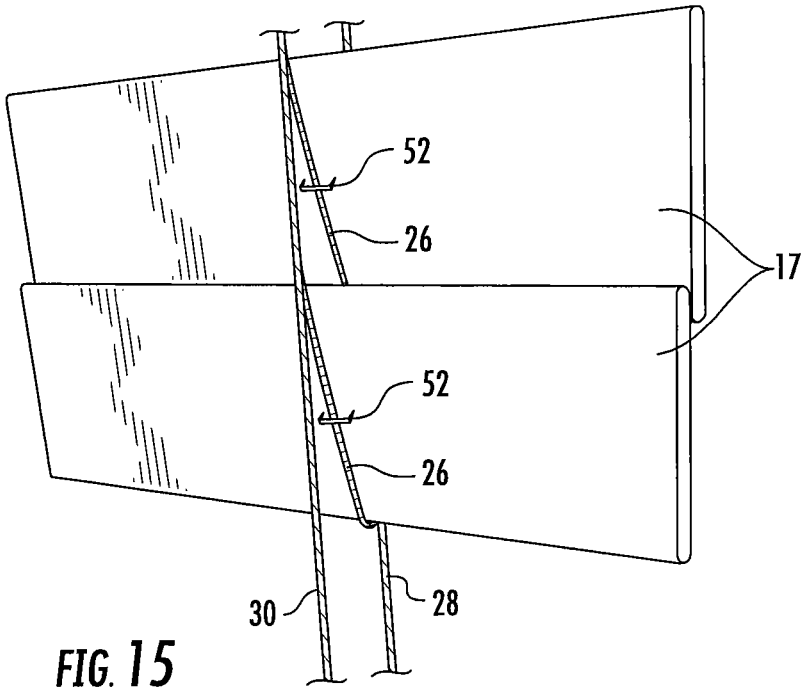
Figure 16:
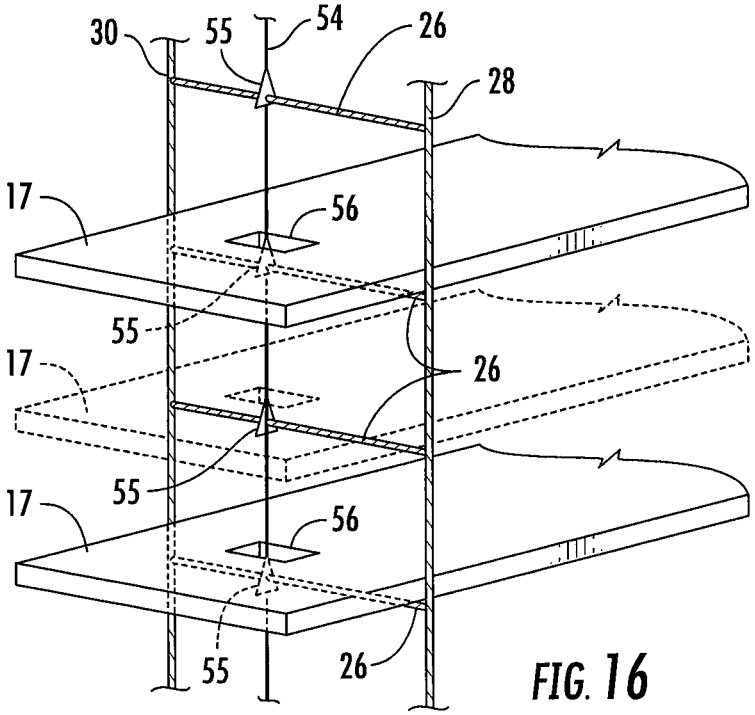
Figure 17:
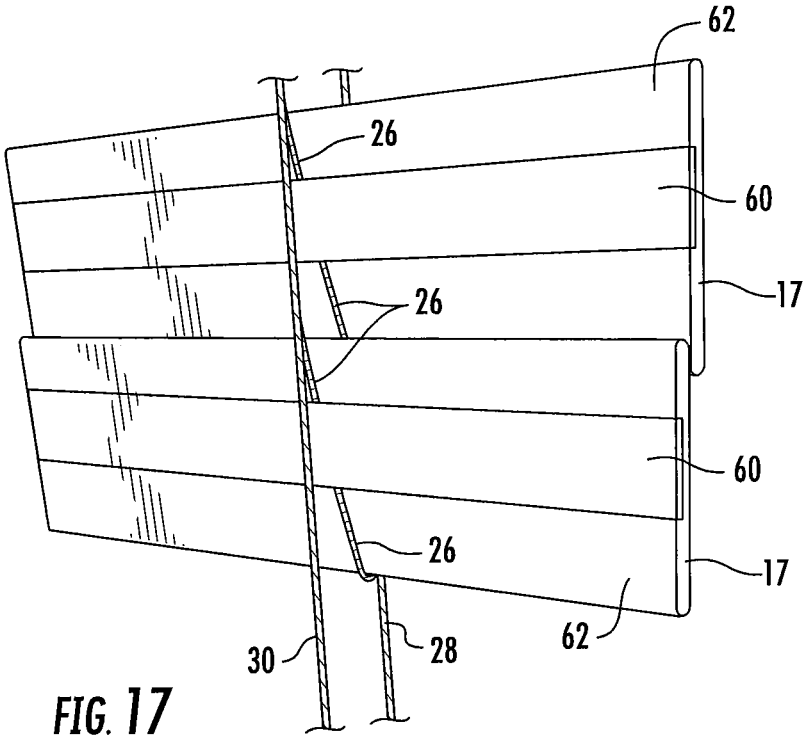
Figure 18:
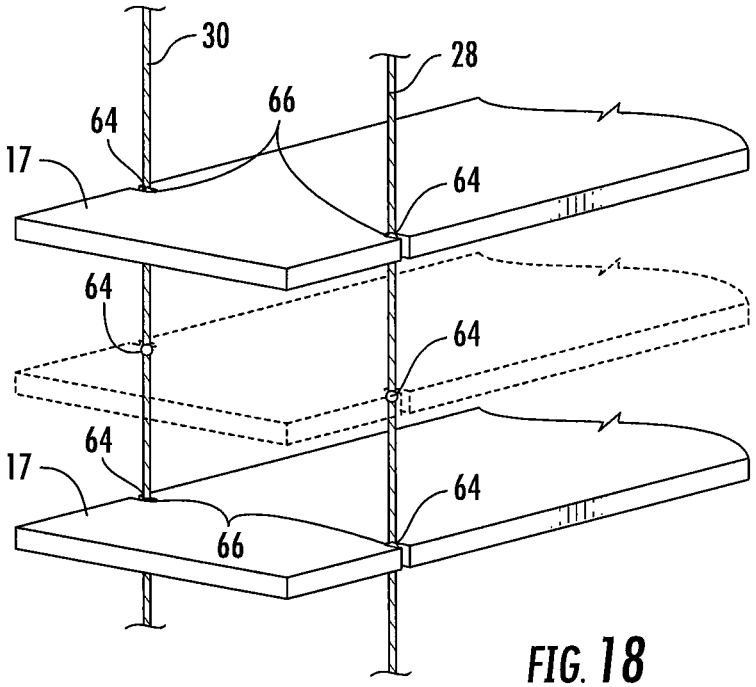
Figure 19:
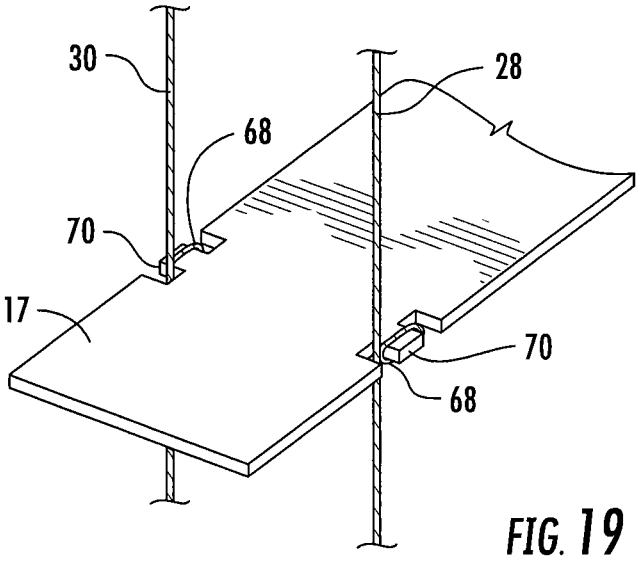
Figure 21:
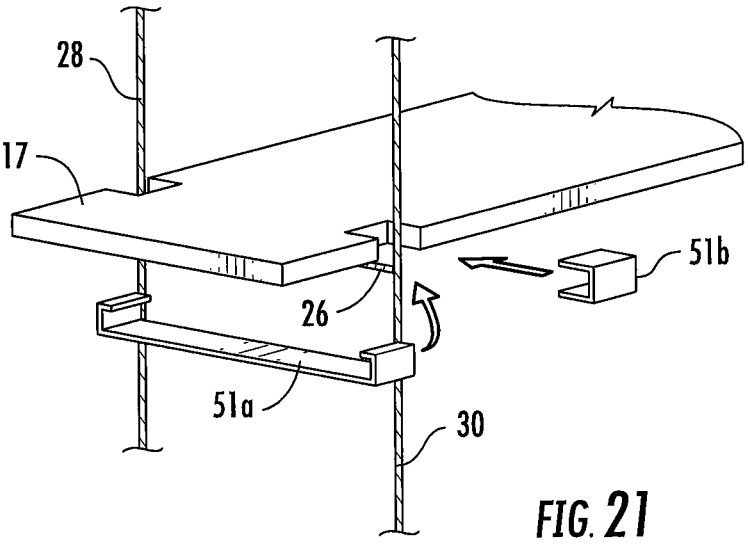
FIGS. 21 through 23 are detailed perspective views showing additional various embodiments of the window covering of FIG. 4.
Figure 22:
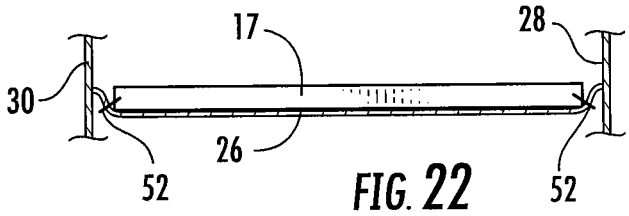
Figure 23:
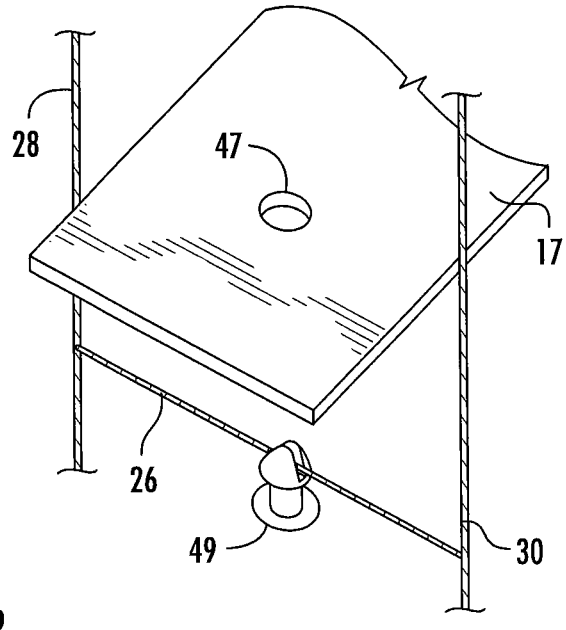

Referring to FIG. 4, in another embodiment of the blind of the invention each slat 17 is connected to the rung 26 on which it is supported such that when the slat 17 is rotated to the closed position the slat 17 is suspended from the rung 26 rather than leaning against the rung and upper cord. In one embodiment the slat is connected to the midpoint of the rung at the transverse midpoint of the slat, point B, by connector 40. While attaching the slat to the midpoint of the slat allows the blind to close in either of the two fully closed positions using a single connector, the slat may be attached to the rung at positions other than the midpoint. Moreover, attaching the slat to the rung at each end of the rung also allows the blind to close in either of the two fully closed positions. With such an arrangement the slat 17 hangs or is suspended from the rung 26 and the upper support cord 30 such that the slat may pivot about the connection at point B such that the top edge of the slat 17 rotates (clockwise as viewed in FIG. 4) into engagement with the adjacent higher slat. In this configuration the slat 17 does not lean against the rung and upper cord but is suspended from the rung and upper cord such that it may freely rotate to the fully closed position. Further, because the slats 17 do not lean against the rung and the upper cord the slats 17 do not tend to spread the cords 28 and 30 apart. The slat 17 may be connected to the rung 26 by any suitable connector 40 that allows the slat to hang from the rung. The connector 40 for attaching the rung 26 to the slat 17 may comprise, but is not limited to, at least one of the following connectors; adhesive 42 (FIG. 10); sonic weld 44 (FIG. 11); tape 46 (FIG. 12); mechanical fastener such as a screw 48 (FIG. 13) or a split rivet 49 (FIG. 22) that engages a hole 47 in the slat and captures the rung, a molded rivet that is molded onto the rung; a snap clip 51*a* that snaps across the slat 17 and engages the rung 26 where the rung 26 joins the vertical support cords 28, 30 or a snap clip 51 b that snaps onto the edges of the slat 17 and engages the rung 26 where the rung joins the vertical support cords 28, 30 (FIG. 21); friction or interference fit 50 where the rung is trapped by cooperating members 51 (FIG. 14); a staple 52 that engages the center of the slat (FIG. 15) or a pair of staples 52 that engage each end of the rung 26 and slat 17 (FIG. 22); a bead that is molded on the rung or a knot formed in the rung 64 that is snapped into a slot on the slat (FIG. 18); a loop 68 formed on the rung that hooks over a peg 70 formed on the slat (FIG. 19); a center lift cord 54 that is threaded through apertures 56 in each of the slats 17 and engages each rung 26 such as by using a connector 55 that connects the center lift cord 54 to the rung 26 (FIG. 16); and/or a two-piece slat that traps the rung 26 between a first slat piece 60 and a second slat piece 62 (FIG. 17) or the like.

Another factor that has been identified as affecting complete blind closure is slat planarity. Because closure of the blind relies on an abutting, overlapping relationship between adjacent slats, variations in planarity between adjacent slats may cause gaps between the slats that allow light to penetrate the blind. It is necessary to ensure that the slats themselves have good planarity. Variations such as bow, warp and camber can cause gaps which prevent complete closure of the slats. Thus, providing slats that have planar surfaces enhances the light blocking performance of the blind by providing a smooth uninterrupted interface between the slats. The variations in the planarity of the slats can be controlled through manufacturing processes, manual segregation of the slats prior to blind assembly and/or by adding a stiffening rib or bend in the slat. Further, a slight reduction in the rung to rung distance may also overcome variations in the slats.

Figure 5:
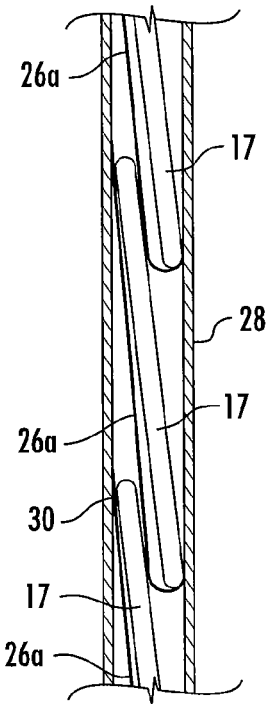
FIG. 5 is a side view of another embodiment of the window covering of the invention.

Another factor that has been identified as affecting complete blind closure is the effective diameter of the rung. As shown in figures the rung that supports each slat is disposed between that slat and the adjacent lower slat when the blind is in the closed position. As a result, the rung acts like a spacer that spaces the top edge of one slat from the bottom edge of the adjacent slat. Thus, minimizing the effective diameter of the rung minimizes the gap between slats caused by the rung. The effective diameter of a rung is the overall diameter of the rung and constitutes the total of the diameters of each fiber of the rung. In one embodiment as shown in FIG. 5 the thickness of the rung 26*a* is reduced from having an effective diameter of 26 mil, as is typical in slatted blinds, to having an effective diameter of 14 mil. A diameter of approximately 14 mil or less has proven to decrease the space between adjacent slats such that light does not penetrate the blind to an unacceptable level at the slat interfaces. One way to reduce the effective rung 26*a* diameter is to make the rung of a single strand rather than the dual strand rung used in a typical blind. The reduced effective diameter of the rung may also be created using a dual or multiple strand rung where each strand is of a reduced diameter. The reduced diameter cord may also be used for the vertical support cords 28 and 30.

Figure 20:
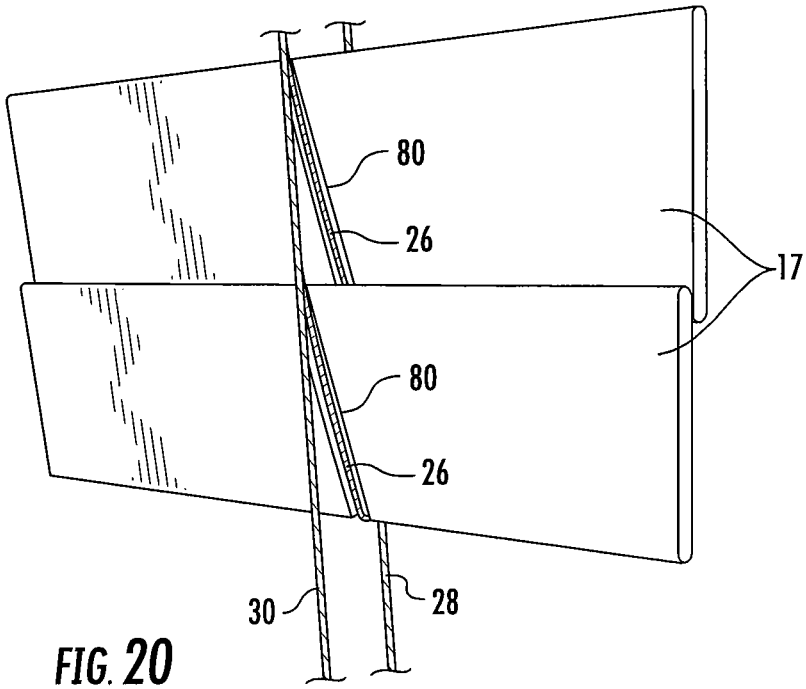
FIG. 20 is a partial perspective view of still another embodiment of the window covering of the invention.

In addition to reducing the effective diameter of the rungs, a slot or recess 80 may be formed in the slats 17 that will accept the rungs 26 such that the rungs 26 are recessed into the slats 17 rather than forming a spacer between the slats as shown in FIG. 20. In the illustrated embodiment the recess 80 extends across the entire width of the slat; however, the recess need only be provided at the edges of the slats where the slats overlap and abut.

Figure 6:
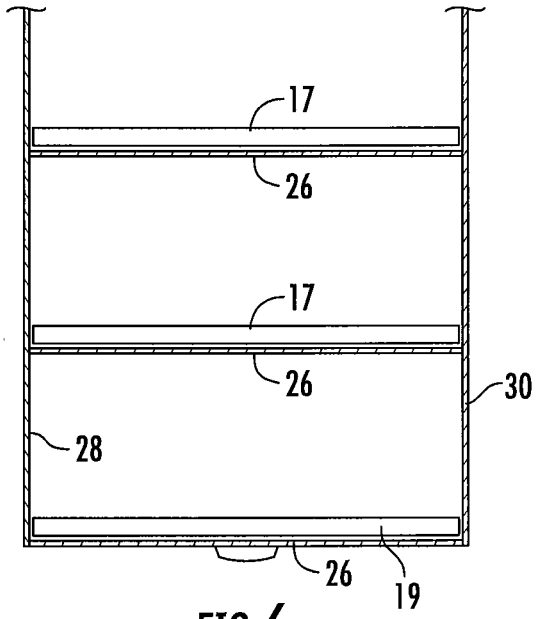
FIG. 6 is a side view of yet another embodiment of the window covering of the invention.

Another factor that has been identified as affecting complete blind closure is the configuration of the bottom rail 19. The typical bottom rail design requires that the ladder tilt cord surrounds the bottom rail. Because, in existing blinds, the bottom rail is thicker than the slats additional, extra length is created in the tilt cord allowing the slats to move due to gravity resulting in a greater angle of slouch of the lower slats. To minimize this issue, in one embodiment of the invention the bottom rail 19 may have a thickness approximately equal to the thickness of the slats 17 as shown in FIG. 6.

Figure 8:
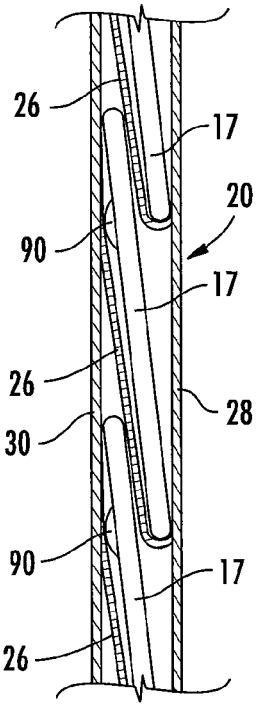
FIG. 8 is a side view of the embodiment of the window covering of FIG. 7.
Figure 7:
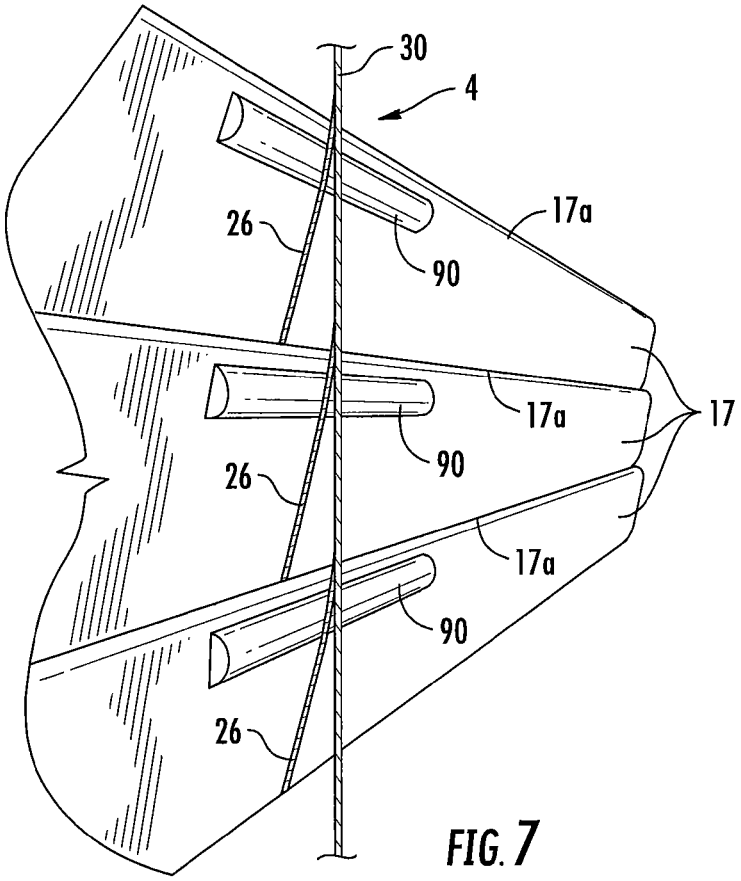
FIG. 7 is a perspective view of an embodiment of the window covering of the invention
Figure 24:
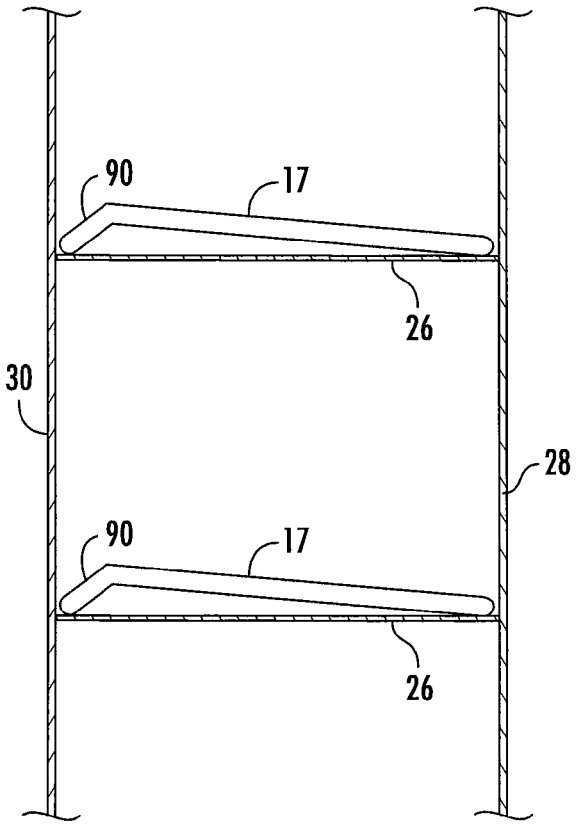
FIG. 24 is a side view showing an alternate embodiment of the window covering shown in FIGS. 7 and 8 in an open position.
Figure 25:
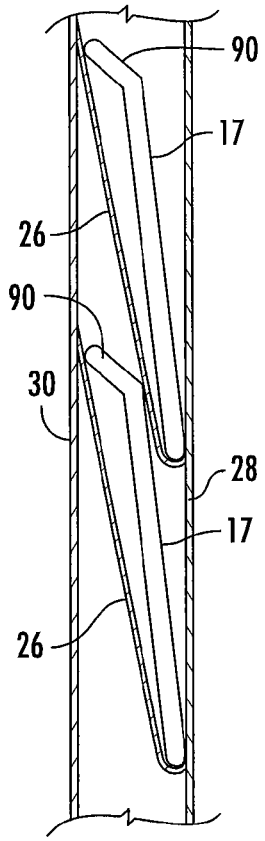
FIG. 25 is a side view showing the embodiment of the window covering of FIG. 24 in a closed position.

In addition to the effective thickness of the bottom rails, it is also possible to add a force in the direction of closure to further push the slats against each other. This can be done using a weight or a mechanism that forces the slat forward against the adjacent slat. Irregularity in planarity of the slats may also be overcome by increasing the closing force with which the slats contact one another when closed. This can be achieved by changing the geometry of the slats such that the closing force will increase while maintaining the traditional visual look of the slats when the slats are in the horizontal open position. Providing a protrusion, bend or bump in the slats allows rung 26 and the upper cord 30 of the ladder cord 20 to push the top of the lower slat against the adjacent upper slat which reduces the variations of the planarity of the slats when the slats are articulated closed and reduces light gaps between slats. One embodiment of such an arrangement is shown FIGS. 7 and 8. A protrusion 90 is formed on the back side of the slats 17. When the tilt cord is articulated to the closed position, the rung 26 pushes against the protrusion 90 to force the upper edge of the slat against the adjacent upper slat. The protrusion 90 may be formed as a separate member attached to the back surface of the slat by a separate attachment mechanism such as adhesive, welding, mechanical fastener or the like. Alternatively, the protrusion 90 may be formed integrally with the slat where the protrusion and slat are extruded or otherwise formed as a single, unitary piece. The protrusion 90 may be formed as a gradually outwardly tapered area of the back surface of the slat. Moreover, the protrusion 90 may be formed as an angled portion formed along the top edge of the slat 17 as shown in FIGS. 24 and 25. In the embodiment of FIGS. 24 and 25 the entire top edge of the slat, or at least the portion of the top edge of the slat that is abutted by rung 26, angles away from, or is bent relative to, the remainder of the slat to create the protrusion 90. The embodiment of FIGS. 24 and 25 facilitates manufacture of the slat. The protrusion extends beyond the back surface of the slat a sufficient distance that the protrusion 90 will force the slat against the adjacent slat. The protrusion 90 is formed on the back surface of the slat 17 near the top edge 17*a* of the slat. As used herein the term "back surface" refers to the surface of the slat that rests on or faces the rung 26 when the blind is open. The term "top edge" as used herein refers to the longitudinal edge of the slat that is disposed toward the top of the blind when the blind is in the closed position.

The protrusion 90 is arranged on the back of the slat 17 such that it is disposed opposite to the ladder cord 20. The protrusion 90, when the slat is in the open position, rests on the rung 26. When the tilt cord 20 and slat 17 are articulated to the closed position, the rung 26 and upper cord 30 push against protrusion 90. The protrusion 90 is dimensioned such that the rung 26 and the upper cord 30 exert a closing force on the protrusion that is transferred to the slat 17 to force the top edge of the slat toward and against the adjacent upper slat. The slats are forced into abutting, overlapping contact and a good light seal is created between the slats. The protrusion 90 helps to accommodate play that may exist in the system due to cord stretching or the like. Providing a protrusion on the slats allows the rung and upper cord to push the top of the slat into engagement with the adjacent higher slat with greater force which reduces the variations of planarity of the slats and forces the slats together when the slats are articulated closed. The slat may have shapes other than planar provided that the protrusion 90 extends beyond the back surface of the slat farther than any other surface variation such that the protrusion may act as a pusher.

Several methods and apparatuses are described herein that may be used to provide full closure of a blind. The methods and apparatuses described above may be implemented independently or they may be implemented in various combinations to improve the ability of a blind to close and block light between the closed slats. The blind as described herein allows the blind to look substantially the same as traditional blinds, as opposed to blinds that use lap joints or similar changes to non-flat slats that significantly change the look of the blind. In addition, the manufacturing methods for the disclosed embodiments are similar to existing construction methods.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A blind comprising:

a plurality of slats;

a tilt cord comprising a first support cord, a second support cord, and a plurality of rungs extending between the first support cord and the second support cord, wherein one of the plurality of rungs supports one of the plurality of slats; and each of the plurality of slats comprising a first slat piece having a first surface secured to a second slat piece having a second surface with one of the plurality of rungs trapped between the first slat piece and the second slat piece to connect one of the plurality of slats to one of the plurality of rungs such that when the plurality of slats are rotated to a closed position the plurality of slats are suspended from the plurality of rungs, the first surface and the second surface together defining a side of the one of the plurality of slats, and the first slat piece and the second slat piece each extending from a first end to a second end of the one of the plurality of slats.

2. The blind of claim 1, wherein the first slat piece is disposed within a slot defined in the second slat piece.

3. The blind of claim 1, wherein the first slat piece is spaced apart from each of a first lateral edge and a second lateral edge of the second slat piece.

4. The blind of claim 1, wherein the first slat piece has a first width, wherein the second slat piece has a second width, and wherein the first width is less than the second width.

5. The blind of claim 1, wherein the first surface of the first slat piece and the second surface of the second slat piece together define a back surface of the one of the plurality of slats.

6. A blind comprising:

a plurality of slats, each of the plurality of slats having a first edge and a second edge;

a tilt cord comprising a first support cord disposed adjacent the first edge of the plurality of slats, a second support cord disposed adjacent the second edge of the plurality of slats, and a plurality of rungs each extending between the first support cord and the second support cord, wherein one of the plurality of rungs supports one of the plurality of slats; and a pair of connectors connecting the first edge and the second edge of the one of the plurality of slats to the tilt cord, wherein the pair of connectors comprises a first loop that is formed on the one of the plurality of rungs and engages a first peg of the one of the plurality of slats formed on the first edge thereof, and a second loop that is formed on the one of the plurality of rungs and engages a second peg of the one of the plurality of slats formed on the second edge thereof.

7. A blind comprising:

a plurality of slats, each of the plurality of slats having a first edge and a second edge;

a tilt cord comprising a first support cord disposed adjacent the first edge of the plurality of slats, a second support cord disposed adjacent the second edge of the plurality of slats, and a plurality of rungs each extending between the first support cord and the second support cord, wherein one of the plurality of rungs supports one of the plurality of slats; and a pair of connectors connecting the first edge and the second edge of the one of the plurality of slats to the tilt cord, wherein the pair of connectors comprises a first molded bead that is molded on the tilt cord and is snapped into a first edge slot on the first edge, and a second molded bead that is molded on the tilt cord and is snapped into a second edge slot on the second edge.

8. A blind comprising:

a plurality of slats, each of the plurality of slats having a first edge and a second edge;

a tilt cord comprising a first support cord disposed adjacent the first edge of the plurality of slats, a second support cord disposed adjacent the second edge of the plurality of slats, and a plurality of rungs each extending between the first support cord and the second support cord, wherein one of the plurality of rungs supports one of the plurality of slats; and a pair of connectors connecting the first edge and the second edge of the one of the plurality of slats to the tilt cord, wherein the pair of connectors comprises a first knot that is formed on the tilt cord and is snapped into a first edge slot on the first edge, and a second knot that is formed on the tilt cord and is snapped into a second edge slot on the second edge.

* * * * *